United States Patent [19]

Lewis et al.

[11] 4,225,312

[45] Sep. 30, 1980

[54] TREATMENT OF TEXTILES

[75] Inventors: David M. Lewis, Otley; Keith R. F. Cockett, Keighley, both of England

[73] Assignee: I.W.S. Nominee Company Limited, London, England

[21] Appl. No.: 929,967

[22] Filed: Aug. 1, 1978

[30] Foreign Application Priority Data

Aug. 4, 1977 [GB] United Kingdom ..... 32803/77

[51] Int. Cl.[2] ..... D06M 3/02; D06M 13/00

[52] U.S. Cl. ..... 8/115.6; 8/682; 8/115.5; 8/128 R; 8/192; 8/404

[58] Field of Search ..... 8/115.5, 115.6, 192, 8/128 R

[56] References Cited

U.S. PATENT DOCUMENTS

| | | | |
|---|---|---|---|
| 2,746,988 | 5/1956 | Doser | 528/71 |
| 2,906,776 | 9/1959 | Doser | 252/8.8 |

FOREIGN PATENT DOCUMENTS

| | | |
|---|---|---|
| 1419306 | 12/1975 | United Kingdom . |
| 1423341 | 2/1976 | United Kingdom . |
| 1423342 | 2/1976 | United Kingdom . |

*Primary Examiner*—A. Lionel Clingman

*Attorney, Agent, or Firm*—Dennis P. Clarke

[57] ABSTRACT

A process for the treatment of textiles, especially to impart shrink resistance thereto, in which there is applied to the textile a water-soluble curable polymeric material in the presence of alkali in an aqueous medium and simultaneously with or subsequently to such application there is applied a compatible exhaustion agent and the polymeric material is exhusted onto the textile and cured thereon.

17 Claims, No Drawings

TREATMENT OF TEXTILES

This invention relates to the treatment of textiles, in particular with water soluble polymeric compounds.

Polymeric materials such as the Bunte salt compounds disclosed in our British Pat. No. 1,423,342 or the poly(carbamoylsulphonates) disclosed in British Pat. No. 1,419,306 are especially suitable as textile finishing agents, in particular in conferring shrink resistance on keratinous textile materials such as wool.

Such resins have hitherto been applied to textile piece goods principally by means of pad mangles. Pad mangles are relatively expensive and not all textile finishers have one. Accordingly, the invention seeks to provide a process of finishing textiles, from either short or long liquors, which may be carried out in widely available wet processing equipment following a simple processing route and using only inexpensive auxiliary chemicals.

According to the present invention there is provided a method of treating textiles which comprises applying a water-soluble curable polymeric material in the presence of alkali together with a compatible exhaustion agent in an aqueous medium to the textile, allowing the polymeric material to exhaust onto the textile, and curing the polymer.

The term 'curing' includes allowing to cure.

Preferred curable polymeric materials have a polymeric chain backbone and at least two thiosulphate groups per molecule. The chain may advantageously be a polyoxyalkylene, e.g. polyoxypropylene, chain. One group of preferred polymers have the following structural formula:

A.

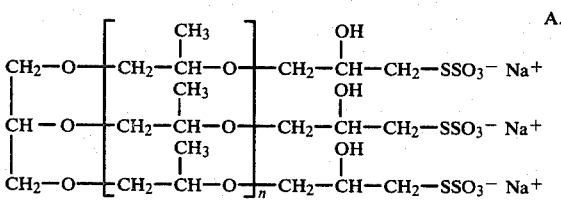

where n is about 13.

Other polymeric materials useful in the process of the invention include poly(carbamoylsulphonates). These may conveniently be prepared from polymeric di- or poly-isocyanates by treatment with sodium bisulphite. Preferred poly(carbamoylsulphonates) have polyoxyalkylene, e.g. polyoxypropylene, backbones and three carbamoylsulphonate groups. Particularly preferred polymers of this type have the following formula:

B.

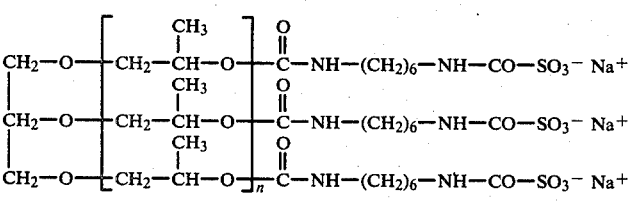

where n is about 13.

In general, the amount of polymeric material applied will be between ½ and 10% on the weight of fibres (o.w.f.), with amounts in the range of 2 to 4% o.w.f. being preferred.

The alkali promotes cross-linking or curing of the polymeric material. Often it is advantageous to pre-mix the alkali with the polymeric material for an ageing period to provide a partially cross-linked, or activated, resin before application to the textile. This is particularly advantageous when operating at long liquor ratios. Typically ageing periods of 10 to 60 minutes may be employed. Any alkali may be used, for example alkali metal carbonates or hydroxides, but particularly good results are obtained using ammonium hydroxide or, at short liquor ratios, trisodium phosphate.

The amount of alkali present should be sufficient to ensure an alkaline reaction of the treatment liquor, preferably a pH value of 8 to 10. It is particularly important in a long liquor to ensure that the weight of alkaline compound present is sufficient to achieve an alkaline reaction on the fabric, which may contain residual acid from a previous process, for example carbonization.

The exhaustion agent may be any soluble compound which reduces the solubility of the polymeric material and does not react adversely with the other compounds present and is preferably ionic in character, especially an inorganic salt. In general, any neutral metal salt may be used. Particularly useful are alkali metal, alkali earth or ammonium salts of strong acids, e.g. $Na_2SO_4$, NaI, $MgSO_4$, $(NH_4)_2SO_4$, $ZnSO_4$ and especially Nacl or $MgGl_2$. It appears that salts of divalent metals are twice as effective, on a weight basis, as salts of monovalent metals. The amounts required vary with the nature of the compound, but in general between 5 and 100 g/l may be used.

As mentioned hereinbefore, the process of the invention can be applied using long or short liquors. When using short liquor ratios typically 1:1 to 3:1, the liquor is vertually completely absorbed by the textile goods. The preferred processing sequence is as follows:

(i) the polymeric material and alkali are mixed and allowed to age;

(ii) the liquor from (i) is applied to the goods in a washing machine or milling machine;

(iii) the goods are agitated until a uniform distribution of the liquor is obtained;

(iv) a solution of inorganic salt is sprayed onto the goods and agitation continued until it is evenly distributed; and (v) the goods are rinsed, hydroextracted and dried.

In order to avoid any risk of slight discoloration of the goods being treated it is preferred to add a mild bleaching agent at a late stage in the process. Suitable agents include oxidising agents such as hydrogen peroxide, and reducing agents such as bisulphites.

No separate curing step is needed since the polymer is fully cured at the end of step (iv). Furthermore, the process can be carried out at room temperature and so energy costs are kept to a minimum.

In order to check that the liquor is evenly distributed at the end of steps (iii) and (iv) sighting colours may be used. For example, a pink sighting colour added to the initial liquor will colour the goods a level pink colour when step (iii) is completed. If a blue sighting colour is added with the salt solution the end of step (iv) can be ascertained when the goods are an even purple colour. Both sighting colours will wash out completely during the rinsing step.

The short liquor process can be carried out in any short liquor processing apparatus capable of agitating the goods, preferably with a tumbling action. Washing machines are especially suitable. For knitwear, e.g. Shetland sweaters, which is generally subjected to a milling operation, the process may be carried out in the milling machine.

When a long liquor is used, typically with liquor ratios from 10:1 up to, say, 100:1, and especially in the range 20:1 to 30:1, suitable machinery may include side-paddle machines, winch machines, beam machines and dolly washers. The preferred processing sequence for long liquor ratios is as follows:

(i) the polymer and alkali are mixed and added to the bath containing the goods;
(ii) a solution of the inorganic salt is added and the temperature raised to 50° C.;
(iii) after about 30 minutes a further addition of inorganic salt is added; and
(iv) after a further 15 to 30 minutes the goods are hydroextracted and dried Thus it can be seen that both long and short liquor processes may be carried out simply using common and inexpensive chemicals in widely available apparatus using a short and simple treatment cycle.

While the process may be used in finishing textiles generally it is especially applicable to textiles of keratinous fibres such as wool. With the latter, resistance to area felting shrinkage during subsequent laundering is conferred.

The process is applicable to textiles in forms varying from loose stock, sliver, top and yarn to piece goods and garments. It has been found particularly useful with knitted piece goods and garments, especially Shetland or lambswool knitwear.

When long liquors are employed, it can be seen that, as the temperature approaches 50° C., the polymer/salt solution becomes milky in appearance, whereas if the temperature is increased it goes clear again. Best results are obtained when carrying out the process at or near the temperature of maximum turbidity.

It is preferred that the goods should be free from dirt, grease or spinning oils and therefore pre-scouring in a detergent solution, preferably non-ionic, is recommended. Non-ionic or anionic detergent may be added to the liquor to ensure complete wetting-out of the goods during processing.

The following Examples are given to illustrate the invention further.

Samples were wash tested in a 'Cubex' washing machine in 15 liters of pH 7 phosphate buffer solution at 40° C. with a 1 kg load including, where necessary, makeweights. Area felting shrinkage results are given as percentage change in area after 1 hour or 3 hours wasing.

EXAMPLE 1

Unscoured Shetland wool swatches (2/8's worsted count yarn; knitted to cover factor 0.85) (1 kg) were prescoured in a Wascator washing machine using a solution containing a non-ionic detergent (Lissapol NX, ICI) 2 g/l, sodium sulphate 2 g/l and sodium metabisulphite 2% o.w.f. Scouring was carried out at 40° C. for 10 min., the goods were then rinsed well and hydroextracted to 50% pick-up.

An activated emulsion of Bunte salt polyether polymer was prepared by dissolving trisodium phosphate (30.0 g) in 1,920 ml of water and then adding 80 ml of a Bunte salt polyether (Lankrolan SHR3, Lankro Chemicals Ltd.) (40% solids) (i.e. 16 g/l Bunte salt polymer, 15 g/l $Na_3PO_4$). Duratint Pink (5 g/l) was also added at this stage. This solution was allowed to age for 30 minutes before adding to the prescoured wool goods. (Allowing for the water remaining on the goods from prescouring this gives a liquor ratio of 2.5:1).

The addition of the activated polymer emulsion to the goods in the Wascator machine may be made either by spraying directly onto the goods with the machine switched on to give a tumbling action, or simply by pouring onto the bulk of the material prior to tumbling. In this Example, tumbling was carried out for thirty minutes during which time the pink tinted solution rapidly distributed itself evenly along the knitted swatches; even those swatches which were quite white at the start of the tumbling cycle were observed to be evenly tinted showing that the liquor had distributed itself evenly.

At this point 500 ml of a blue tinted 6% (w/v) solution of sodium chloride was added to the Wascator, again either by spraying or simply by pouring onto the bulk of the swatches. (The effective liquor ratio was then 3:1).

Tumbling was carried out for a further 15 min., when it was seen that all the swatches were uniformly tinted. The swatches were then rinsed with cold water to remove both the tints and the inorganic salts. Hydroextraction and drying completed the process.

Three sample swatches were taken from the front, centre and back of the machine and without drying were subjected to the 15-liter Cubex wash test. The following results were obtained:

| | % Area shrinkage | |
|---|---|---|
| Sample | 1 hour wash | 3 hour wash |
| Front of machine | −2 | 0 |
| Centre of machine | 1 | 1 |
| Back of machine | −3 | −1 |
| Scoured only | 35 | 61 |

Negative values indicate an extension.

EXAMPLE 2

The procedure of Example 1 was essentially followed, except that processing was carried out in a "Cherry Tree" milling machine commonly used for milling woollen garments. Again, good machine washability without intermediate drying was obtained.

EXAMPLE 3

An all wool woven worsted 2/2 twill fabric was scoured in the usual way and then placed in a conventional fabric milling machine. An activated (½ hour aged) liquor (16 g/l Lankrolan SHR3, 15 g/l trisodium phosphate) was prepared as in Example 1 and 100 kg added slowly by pouring directly onto the moving fabric (40 Kg). The pressure on the throat of the milling machine was adjusted so that after 15 minutes 6% width shrinkage had occurred. After this time the pressure was relaxed and after running for a further 15 minutes it was seen that level distribution of the liquor over the fabric had been produced. At this stage 50 kg of a 6% sodium chloride solution was added and the fabric run a further fifteen minutes under very little throat pressure. Rinsing with water, hydroextraction and drying complted the process.

Cubex testing (15 liter, 3 hours) gave zero area shrinkage compared with 43% for the untreated fabric.

EXAMPLE 4

Shetland fabric (2/8's worsted count yarn knitted to cover factor 0.85) was scoured and milled in Lissapol NX (2 g/l) and anhydrous sodium sulphate (2 g/l). The wool was then rinsed.

In a fresh bath at 20° C. and 30:1 liquor ratio, 1.5 g/l 0.880 ammonia was added followed 5 minutes later by 3.5% (solids) o.w.f. Lankrolan SHR 3. 15 g/l sodium chloride was then added and the whole raised to 50° C. over 10 min. Exhaustion to about 90% occurred over 30 min. whereupon a further 5 g/l sodium chloride was added and circulation continued for a further 30 min.

At this stage the wool passed the I.W.S. Superwash (TM 185) felting shrinkage test (1st hour 0%; 2nd hour 1%; 3rd hour 2%). However, it was conventionally hydroextracted and tumble dried at 90° C. for 15 min., when the shrinkage figures were found to be similar to those of the undried fabric.

EXAMPLE 5

The Shetland fabric of Example 4 was scoured and milled. A stock solution was made up containing 80 g/l Lankrolan SHR3 and 20 g/l ammonia. This was aged for 30min. The scoured and milled wool was wetted out at a liquor ratio of 30:1 at 20° C. and the bath brought to pH 9 by the addition of ammonia. The resin stock was then added to a dosage level of 3.5% o.w.f. resin solids followed by 15 g/l sodium chloride. The bath was raised to 50° C. and circulated for 30 min. A further 5 g/l sodium chloride was then added and circulation continued for 30 min.

The goods were then hydroextracted and tumble dried (90° C., 15 min.) and Cubex tested:

| | 1 hour | 2 hour | 3 hour |
|---|---|---|---|
| Area shrinkage: | −1 | 3 | 5 |

If Cubex testing is carried out before drying, equally good results are recorded, indicating that polymer crosslinking occurs on the fabric before drying.

EXAMPLE 6

A worsted serge fabric was treated on a winch machine by the method of Example 2. After hydroextraction and drying, the fabric was Cubex tested and found to give an area shrinkage value (3 hour, 15-liter test) of 0%. The untreated fabric gave a value of 43%.

EXAMPLE 7

Shetland wool samples are scoured and milled as in Example 4.

The procedure of Example 4 was then followed except that 10 g/l magnesium sulphate was added instead of the sodium chloride. The pH of the treatment liquor was 9.5.

The temperature was raised to 50° C. over 10 min. and then held at 50° for 5 min., whereupon 2% o.w.f. of sodium metabisulphite was added and the bath run a further 15 min. at the same temperature.

The samples were then hydroextracted and the following wash test results obtained on samples which had been air dried or tumble dried.

| | Area Shrinkage % | | |
|---|---|---|---|
| | 1 hour wash | 2 hour wash | 3 hour wash |
| Air dried | 1 | 2 | 3 |
| Tumble dried | 0 | 0 | 1 |

EXAMPLE 8

The scoured and milled fabric of Example 4 was immersed in a bath set at 35° C. and 30:1 liquor: goods ratio. 1.5 g/l 0.880 ammonia was added followed after 5 minutes by 3.0% (solids) o.w.f. Lankrolan SHR 3. 4 g/l $MgCl_2.6H_2O$ is added and the temperature raised to 50° C. at the rate of 1° C./minute and circulation of the goods is continued for 30 minutes at 50° C.

At this stage the wool passes the IWS Superwash (TM 185) felting shrinkage test (area felting shrinkage less than 10% after three hours test washing). However the Shetland fabric was rinsed, hydroextracted and tumble dried, when the shrinkage figures were found to be similar to those of the undried fabric.

EXAMPLE 9

The scoured and milled fabric of Example 4 was immersed in a bath at 25° C. and 30:1 liquor: goods ratio. 6 g/l $MGCL_2.6H_2O$ was added followed by 0.5 g/l 0.880 ammonia and 2.5% of the bisulphite adduct of Synthappret LKF (Bayer) prepared by known techniques, as described in U.K. Pat. No. 1419306. The bath is run for 15 minutes at 25° C. and then rinsed, at 1° C./min, to 50° C. at which temperature it is held until exhaustion is completed evidenced by the bath clearing (about 15 minutes).

The fabric passed the wash test (less than 10% area felting shrinkage after 3 hours wash).

EXAMPLE 10

Multicoloured Shetland garments (2/12's w.c., cover factor 0.85) were scoured and milled as in Example 4. Samples were immersed in a bath set at 5° C. and 30:1 liquor ratio. 1.5 g/l 0.880 ammonia was added followed consecutively by 1.5% (solids) o.w.f. Impranil DLH, 2.0% (solids) o.w.f. Lankrolan SHR3 and 3.0 g/l $MgCl_2.6H_2O$. (Impranil DLH is an anionic aliphatic polyester urethane dispersion supplied by Bayer AG as a 40% aqueous dispersion). The bath temperature is raised to 50° C. at 1° C./min, and maintained at 50° C. for 30 minutes.

After the treatment there was no cross-staining of the dyestuffs, and the garments passed the wash test.

We claim:

1. A method of treating keratinous fiber containing textiles comprising applying to the textile a water soluble, curable polymeric material in the presence of an alkaline compound, from an aqueous medium, and simultaneously or subsequently applying to the textile while the textile is in contact with said alkaline aqueous medium a compatible exhaustion agent which reduces the solubility of the polymeric material comprising a soluble inorganic salt, allowing the polymeric material to exhaust onto the textile and curing the polymeric material; the said polymeric material being selected from the group consisting of (a) Bunte salt compounds comprising a polyoxyalkylene polymeric chain backbone and at least two thiosulfate groups per molecule and (b) poly(carbamoyl-sulfonates) prepared by reaction of a polymeric di- or poly-isocyanate with a bisulfite.

2. A method of treating keratinous fiber containing textiles comprising applying to the textile a water soluble, curable polymeric material in the presence of an alkaline compound, from an aqueous medium, and simultaneously or subsequently applying to the textile while the textile is in contact with said alkaline aqueous medium a compatible exhaustion agent which reduces the solubility of the polymeric material comprising a soluble inorganic salt, allowing the polymeric material to exhaust onto the textile and curing the polymeric material; the said polymeric material being selected from the group consisting of (a) Bunte salt compounds comprising a polyoxyalkylene polymeric chain backbone and at least two thiosulfate groups per molecule and (b) poly(carbamoyl-sulfonates) prepared by reaction of a polymeric di- or poly-isocyanate with a bisulfite wherein said aqueous medium containing the said curable polymeric material and alkaline compound is a short liquor having a weight ratio to the textile of from 1:1 to 3:1 in which:

(i) the polymeric material and alkali are mixed and allowed to age:

(ii) the liquor from (i) is applied to the textile in a washing machine or milling machine;

(iii) the textile is agitated until a uniform distribution of the liquor is obtained;

(iv) a solution of inorganic salt is sprayed onto the textile and agitation continued until it is evenly distributed; and (v) the textile is rinsed, hydroextracted and dried.

3. A method of treating keratinous fiber containing textiles comprising applying to the textile a water soluble, curable polymeric material in the presence of an alkaline compound, from an aqueous medium, and simultaneously or subsequently applying to the textile while the textile is in contact with said alkaline aqueous medium a compatible exhaustion agent which reduces the solubility of the polymeric material comprising a soluble inorganic salt, allowing the polymeric material to exhaust onto the textile and curing the polymeric material; the said polymeric material being selected from the group consisting of (a) Bunte salt compounds comprising a polyoxyalkylene polymeric chain backbone and at least two thiosulfate groups per molecule and (b) poly(carbamoyl-sulfonates) prepared by reaction of a polymeric di- or poly-isocyanate with a bisulfite, wherein the aqueous medium containing the curable polymer material and alkaline compound comprises a long liquor having a weight ratio to the textile of from 10:1 to 100:1 in which:

(i) the polymer and alkali are mixed and added to the bath containing the textile;

(ii) a solution of the inorganic salt is added and the temperature raised to 50° C.;

(iii) after about 30 minutes a further addition of inorganic salt is added; and, (iv) after a further 15 to 30 minutes the textile is hydroextracted and dried.

4. A method as claimed in claim 1, in which the polyoxyalkylene chain is a polyoxypropylene chain.

5. A method as claimed in claim 1 in which the polymeric material has the formula:

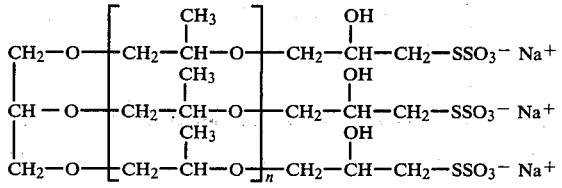

where n is about 13.

6. A method as claimed in claim 1, in which the polymeric material has the formula:

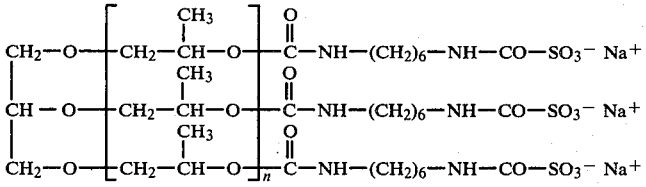

where n is about 13.

7. A method as claimed in claim 1, in which the amount of polymeric material applied is between ½ and 10% on the weight of fibres.

8. A method as claimed in claim 7, in which the amount of polymeric material applied is in the range of 2 to 4% on the weight of fibres.

9. A method as claimed in claim 1, in which the alkali is pre-mixed with the polymeric material for an aging period before application to the textile.

10. A method as claimed in claim 9, in which the aging period is from 10 to 60 minutes.

11. A method as claimed in claim 1, in which the alkali is ammonium hydroxide or trisodium phosphate.

12. A method as claimed in claim 1, in which sufficient alkali is used to ensure a pH value of 8 to 10.

13. A method as claimed in claim 1, in which the inorganic salt is selected from alkali metal, alkaline earth metal and ammonium salts of strong acids.

14. A method as claimed in claim 13, in which the exhaustion agent is selected from sodium sulphate, sodium iodide, magnesium sulphate, ammonium sulphate and zinc sulphate.

15. A method as claimed in claim 13, in which the exhaustion agent is sodium chloride.

16. A method as claimed in claim 13, in which the exhaustion agent is magnesium chloride.

17. A method as claimed in claim 1, in which the amount of exhaustion agent used is between 5 and 100 g/l of the treatment liquor.

* * * * *